US006992627B1

(12) United States Patent
Honda et al.

(10) Patent No.: US 6,992,627 B1
(45) Date of Patent: Jan. 31, 2006

(54) SINGLE AND MULTIBAND QUARTER WAVE RESONATOR

(75) Inventors: Royden Honda, San Jose, CA (US); Greg Johnson, Aptos, CA (US); Robert Hill, Salinas, CA (US); Don Keilen, Sparks, NV (US)

(73) Assignee: RangeStar Wireless, Inc., Aptos, CA (US)

( * ) Notice: Subject to any disclaimer, the term of this patent is extended or adjusted under 35 U.S.C. 154(b) by 181 days.

(21) Appl. No.: 09/677,226

(22) Filed: Sep. 29, 2000

Related U.S. Application Data

(63) Continuation-in-part of application No. 09/382,179, filed on Aug. 24, 1999, now Pat. No. 6,239,765.

(60) Provisional application No. 60/157,945, filed on Oct. 6, 2000.

(51) Int. Cl.
*H01Q 1/38* (2006.01)

(52) U.S. Cl. ..... 343/700 MS; 343/702

(58) Field of Classification Search ..... 343/700 MS, 343/702, 795, 828, 846, 848
See application file for complete search history.

(56) References Cited

U.S. PATENT DOCUMENTS 6,091,366 A * 7/2000 Zhang et al. ..... 343/700 MS
6,107,967 A * 8/2000 Hill ..... 343/702
6,111,545 A * 8/2000 Saari ..... 343/702
6,181,282 B1 * 1/2001 Gans et al. ..... 343/700 MS

* cited by examiner

*Primary Examiner*—Tan Ho
(74) *Attorney, Agent, or Firm*—Fulbright & Jaworski L.L.P.

(57) ABSTRACT

A single or multiple band quarter wave resonator antenna assembly for a communications device including a resonator element as a substrate element having disposed thereupon at least a pair of conductor trace elements. The conductor trace elements are disposed upon opposite sides of the substrate element and are operatively coupled to the communications device. The antenna assembly further including a separate conductive member having an approximate ¼ wavelength or greater dimension, which may be defined as the internal printed wiring board ground plane of the communications device.

1 Claim, 5 Drawing Sheets

SINGLE AND MULTIBAND QUARTER WAVE RESONATOR

This application claims the benefit of priority pursuant to 35 USC §119(e)(1) from the provisional patent application filed pursuant to 35 USC §111(b): as Ser. No. 60/157,945 on Oct. 6, 2000.

This is a continuation-in-part of application Ser. No. 09/382,179 filed on Aug. 24, 1999, now U.S. Pat. No. 6,239,765 the benefit of priority from which is hereby claimed pursuant to the provisions of 35 USC §120.

FIELD OF THE INVENTION

The present invention relates to an antenna assembly for a wireless communication device, such as a cellular telephone. Particularly, the present invention relates to compact antenna assemblies including a GPS-frequency quarter wave resonator and a single or multiple band quarter wave resonator of associated wireless communication devices.

BACKGROUND OF THE INVENTION

Known wireless communications devices such as hand-held cell phones and data modems (LANs) typically are equipped with an external wire antenna (whip), which may be fixed or telescoping. Such antennas are inconvenient and susceptible to damage or breakage. The overall size of the wire antenna is relatively large in order to provide optimum signal characteristics. Furthermore, a dedicated mounting means and location for the wire antenna are required to be fixed relatively early in the engineering process.

Several other antenna assemblies are known, including:

Quarter Wave Straight Wire Antenna

This is a ¼ wavelength external antenna element, which operates as one side of a half-wave dipole. The other side of the dipole is provided by the ground traces of the transceiver's printed wiring board (PWB). The external ¼ wave element may be installed permanently at the top of the transceiver housing or may be threaded into place. The ¼ wave element may also be telescopically received into the transceiver housing to minimize size. The ¼ wave straight wire adds from 3–6 inches to the overall length of an operating transceiver.

Coiled Quarter Wave Wire Antenna

An antenna having an external small diameter coil that exhibits ¼ wave resonance, and which is fed against the ground traces of the transceiver's PWB to form an asymmetric dipole. The coil may be contained in a molded member protruding from the top of the transceiver housing. A telescoping ¼ wave straight wire may also pass through the coil, such that the wire and coil are both connected when the wire is extended, and just the coil is connected when the wire is telescoped down. The transceiver overall length is typically increased by ¾–1 inch by the coil.

Planar Inverted F Antenna (PIFA)

An antenna having an external conducting plate which exhibits ¼ wave resonance, and which is fed against the ground traces of the PWB of a transceiver to form an asymmetric dipole. The plate is usually installed on the back panel or side panel of a transceiver and adds to the overall volume of the device.

Patch

An antenna including a planar dielectric material having a resonant structure on one major surface of the dielectric and a second ground plane structure disposed on the opposite major surface. A conductive post may electrically couple (through the dielectric) the resonant structure to a coaxial feedline.

GPS

GPS antennas for portable or mobile equipment generally have the form of a microstrip patch or a quadrifilar helix. The microstrip patch may be installed internally in some wireless communications devices, and size for 1575 MHz is typically reduced by dielectric loading, which also increases costs and weight. The quadrifilar helix is of substantial size, and is mounted externally, where it is subject to damage. The manufacturing cost of either the patch or quadrifilar helix is greater than for an antenna according to the present invention.

Additionally, there have been numerous efforts in the past to provide an antenna inside a portable radio communication device. Such efforts have sought at least to reduce the need to have an external whip antenna because of the inconvenience of handling and carrying such a unit with the external antenna extended.

SUMMARY OF THE INVENTION

In view of the above-mentioned limitations of the prior art antennas, it is an object of the present invention to provide an antenna for use with a portable wireless communications device.

It is another object of the invention to provide an antenna unit which is lightweight, compact, highly reliable, and efficiently produced.

The present invention replaces the external wire antenna of a wireless communication device with a printed dielectric substrate element which is disposed within the housing of a wireless device and closely-spaced to the printed wiring board (PWB) and antenna feedpoint of the wireless device. Electrical connection to the wireless device's PWB may be achieved through automated production equipment, resulting in cost effective assembly and production. Electrical performance of the internal (embedded) antenna in wireless systems is nominally equal to that of a conventional wire antenna.

It is an object of the present invention to provide an antenna assembly which can resolve the above shortcomings of conventional antennas. Additional objects of the present invention include: the elimination of the external antenna and its attendant faults such as susceptibility to breakage and impact on overall length of the transceiver; the provision of an internal antenna that can easily fit inside the housing of a wireless transceiver such as a cell phone, with minimal impact on its length and volume; the provision of a cost effective antenna for a wireless transceiver, having electrical performance comparable to existing antenna types; and, the reduction in SAR (specific absorption rate) of the antenna assembly, as the antenna exhibits reduced transmit field strength in the direction of the user's ear for hand held transceivers such as a cellular telephone, when compared to the field strength associated with an external wire type antenna system.

In a preferred embodiment, the resonator devices may exhibit resonant frequency ranges within the GPS, 860–990 Mhz, and 1710–1880 Mhz frequency ranges. Alternatively, the resonator devices may operate at the GPS and a single band, such as 860–990 MHz or 1710–1880 MHz ranges.

It is an object of the present invention to provide a GPS (Global Positioning System) antenna quarter wave resonator and single or multiband antenna quarter waves resonator for wireless communications frequencies that are co-located on a common second conductor to form an asymmetrical dipole dual or multiband antenna system with separate feed for the GPS antenna portion. The common second conductor may be supplied by the PWB of a wireless communication device such as a cell phone. The GPS and wireless band resonators may be formed as printed circuits on a dielectric substrate using known circuit board fabrication processes and techniques, resulting in a low cost antenna suitable for high volume manufacturing.

The present invention provides an antenna assembly including a first conductive trace element disposed upon the resonator element. The resonant frequency range of the trace may be selected to exhibit ¼ wave resonance. In the preferred embodiment the first printed circuit element is rectangular having a thickness in the range 0.010–0.125 inches. Alternatively, the conductive trace may be printed on any number of conventional dielectric materials having a low to moderate dielectric loss such as plastics and fiberglass. Furthermore, the compact size of the resonator element may conform to available volume in the housing of a wireless transceiver such as a cellular telephone. The antenna assembly may be excited or fed with 50 ohm impedance, which is a known convenient impedance level found at the receiver input/transmitter output of a typical wireless transceiver.

The combined antenna system allows a GPS-based mobile station locating system to be incorporated with wireless devices such as cell phones. The non-GPS portion of the antenna system may be configured to operate over cell phone bands of interest, such as 824–894 MHz/1850–1990 MHz or 880–960 MHz/1750–1880 MHz.

The above and other objects and advantageous features of the present invention will be made apparent from the following description with reference to the accompanying drawings, in which like reference characters designate the same or similar parts throughout the drawings.

BRIEF DESCRIPTION OF THE DRAWINGS

The above set forth and other features of the invention are made more apparent in the following Detailed Description of Preferred Embodiments when read in conjunction with the attached drawings, wherein.

DETAILED DESCRIPTION OF PREFERRED EMBODIMENTS

Figure 1:
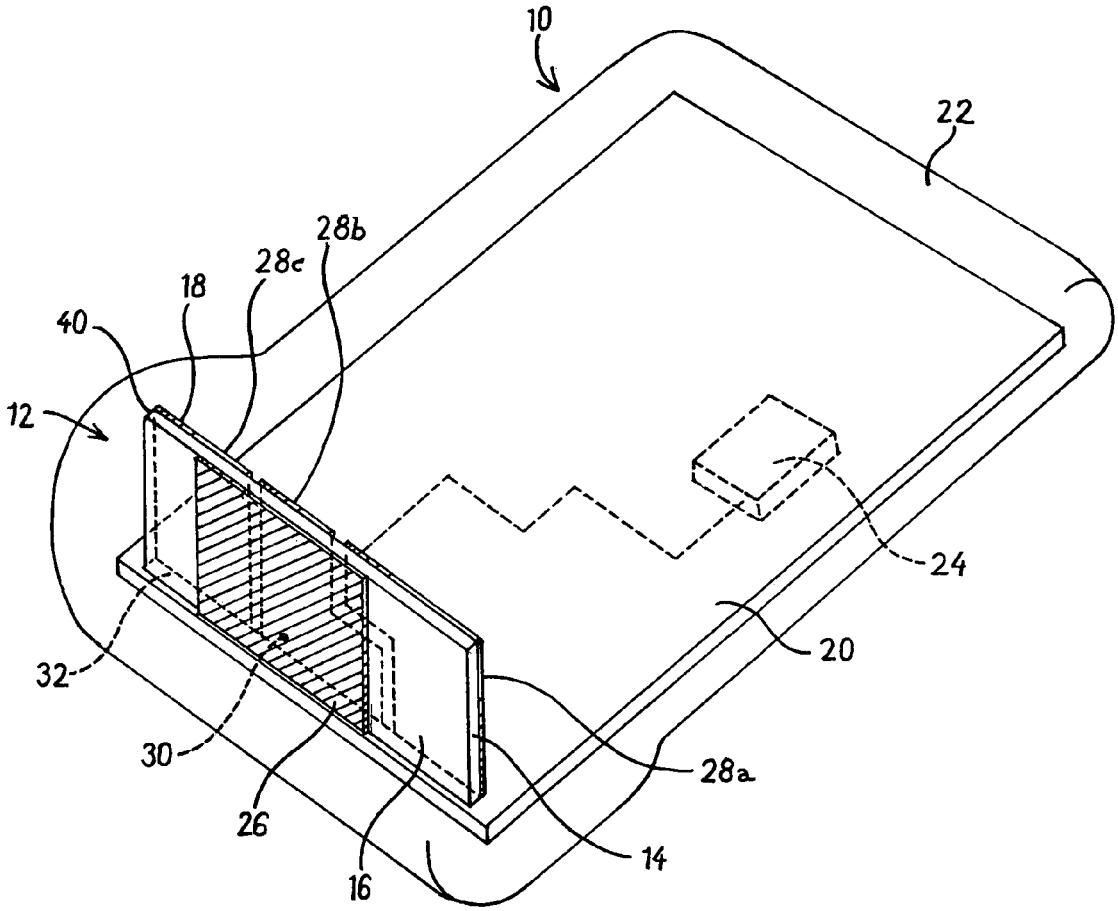
FIG. 1 illustrates a perspective view of a wireless communications device utilizing an antenna assembly according to the present invention.

FIG. 1 illustrates an antenna assembly 12 being disposed within a wireless communications device 10, such as a cellular telephone or PDA device. The antenna assembly 12 includes a resonator element 14 having a pair of opposed surfaces 16, 18 and a ground plane element 20. The ground plane element 20 may be the internal ground plane of a printed wiring board (PWB) of the communications device 10. Ground plane element 20 includes a dimension of approximately ¼ wavelength or greater. In preferred embodiments, the antenna assembly 12 can be implemented to transmit and receive on desired frequencies, including analog or digital U.S. or European cell phone bands, PCS cell phone bands, 2.4 GHz BLUETOOTH™ bands, or other frequency bands as would be obvious to one skilled in the art.

The antenna assembly 12, disposed near the upper portion of the device 10 (away from the user's hand during operation), is received and incorporated within the housing 22 of the device 10. Although the antenna assembly 12 can be installed in locations within or external to the housing 22, it is presently preferred that it be disposed within the housing 22. Wireless communication device 10 contains electrical apparatus, such as a receiver and/or transmitter, herein referred for convenience together as a transceiver component 24.

Figure 2:
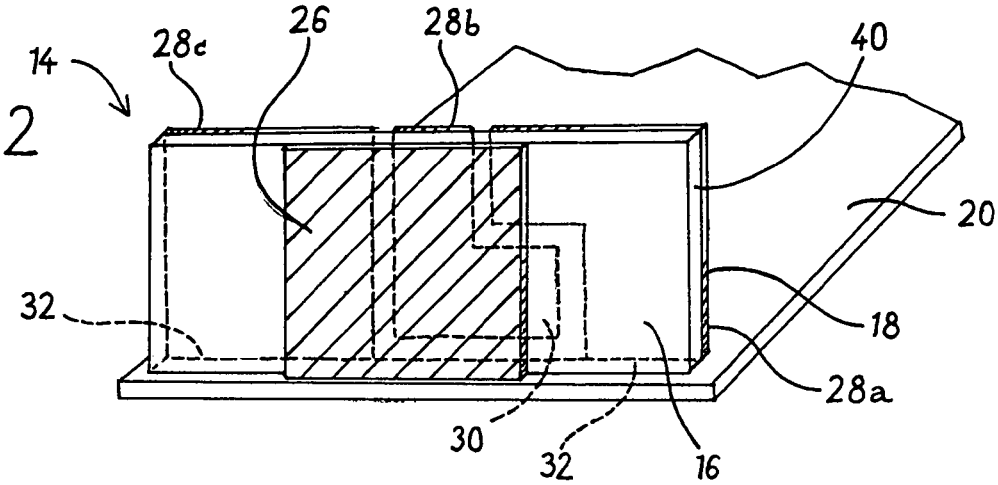
FIG. 2. is a first side elevational view of the resonator element of the antenna assembly of FIG. 1.

As illustrated in the FIGS. 1 and 2, the resonator element 14 may be disposed in substantially perpendicular relationship to the ground plane element 20. A first conductor trace 26 is disposed upon a surface 16 of the resonator element 14, and second conductor traces 28*a,b,c* are disposed upon the opposite surface 18 of the resonator element 14. The lower edge of each of the outer second conductor traces 28*a,c* is within approximately 1–4 mm (vertical distance) from the ground plane 20. The outer second conductor traces 28*a,c* are coupled to the signal ground proximate connection region 32. The central second conductor trace 28*b* is operatively coupled to the transceiver signal input/output componentry 24 via connection 30.

The first and second conductor traces 26, 28 of the antenna assembly 12 are disposed upon respective first and second surfaces 16, 18 of the resonator element 14, which may be a printed wiring board (PWB) 40 or similar materials capable of supporting the conductor traces. Both the first and second conductor traces 26, 28 may be disposed upon the substrate 40 using known circuit fabrication techniques, such as surface printing, photolithography, and etching processes. The dimensions of the resonator element 14 may be varied to conform to a portion of the housing 22. Those skilled in the arts will appreciate that the design and selection of either the first or second planar elements 22,24 with reference to a particular wireless communication device may result in such complex shapes.

Figure 3:
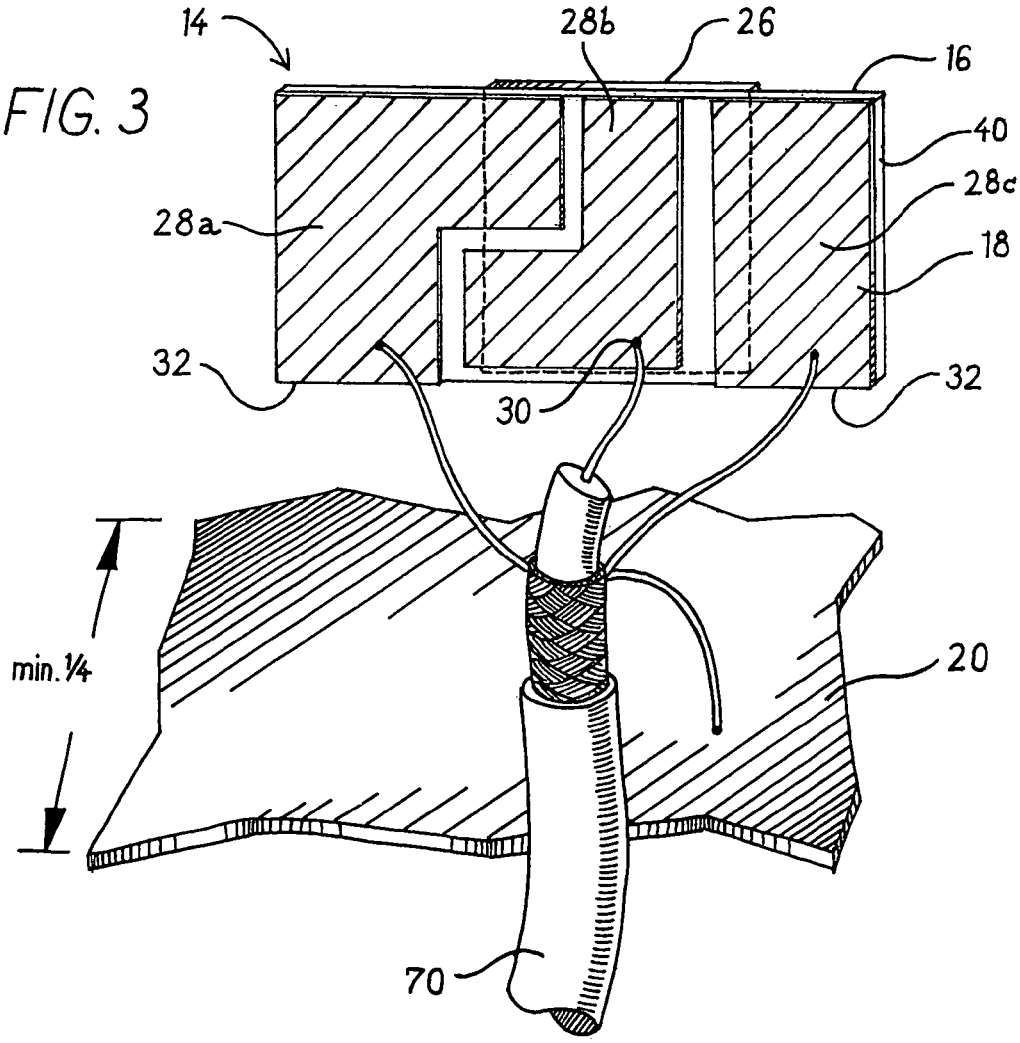
FIG. 3 is a second side elevational view of the resonator element of the antenna assembly of FIG. 1.

Referring to FIGS. 2 and 3, a particular GPS resonator device 14 is disclosed. Resonator device 14 includes a substrate 40, such as a double sided printed wiring board having a relative dielectric constant in the range 2–10. The substrate 40 may be of Duroid or glass fiber, or known dielectric printed circuit board material. The substrate element 40 may be a dielectric PC board having a thickness between 0.005" to 0.125" thick. A flexible PCB substrate may also be practicable. FIG. 2 illustrates the resonator device 14 disposed in substantially perpendicular relationship to the ground plane element 20, such as the internal ground plane of the wireless communications device 10, and being fed directly from the signal lines on the PCB at connection regions 30 and 32. An alternative antenna 12 feed approach is disclosed in FIG. 3, where the resonator device 14 is coupled to a coax feedline 70 and a separate conductive plate element of approximately 1 wavelength or greater dimension such as the ground plane 20 of the wireless device 10. The center conductor of the coax line 70 is coupled at connection 30 to the central second conductor trace 28*b*, while the shield conductors of the coax line 70 are coupled to the second conductor traces 28*a,c* and the separate ground conductor element 20.

Conductor elements 26,28 of the resonator device 14 preferably have thicknesses in the range 0.0005–0.01 inches. The first conductor trace element 26 is an electrical quarter wave resonator for 1575 MHz. The second conductor trace elements 28 form a feed network. Electrical connection between conductor trace elements 26 and central second conductor trace 28*b* is via capacitive coupling. Conductor element 28*b* is connected to the RF port of the wireless device at connection 30.

Figure 4:
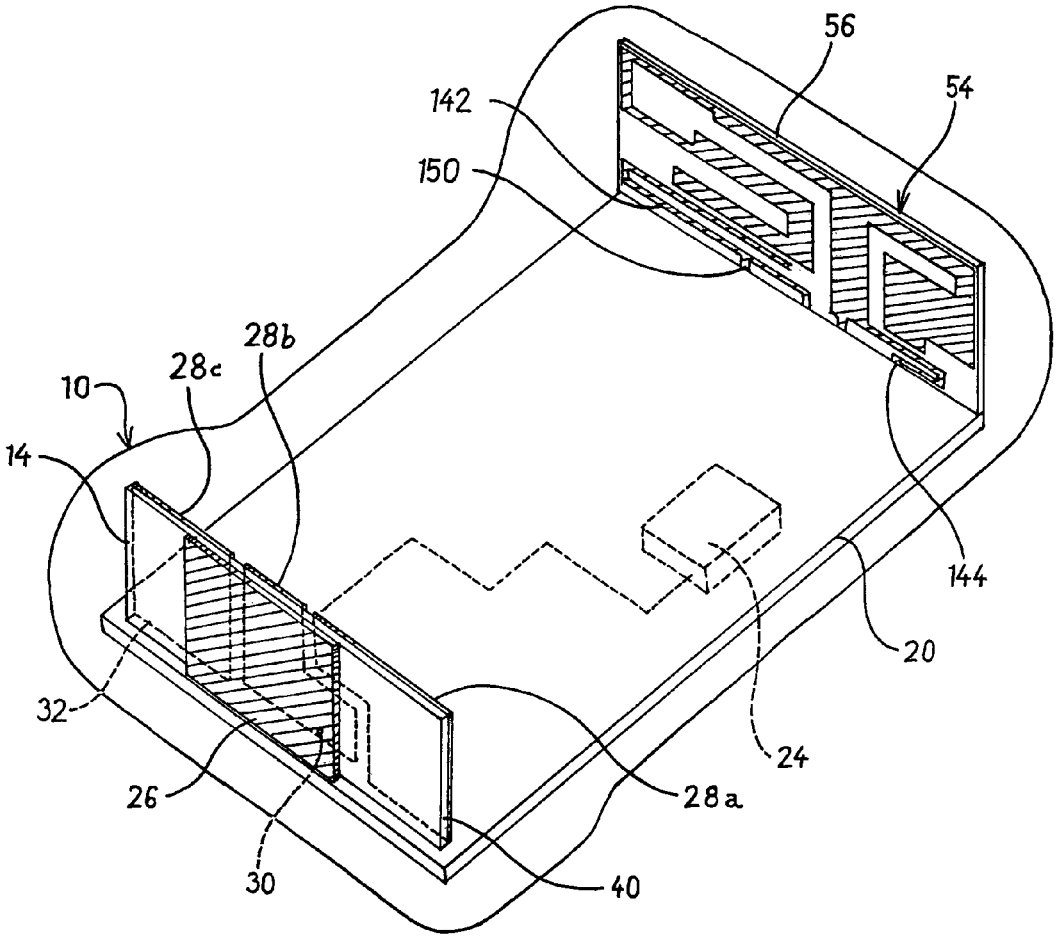
FIG. 4 illustrates a perspective view of a wireless communications device utilizing another embodiment of an antenna assembly according to the present invention.
Figure 5:
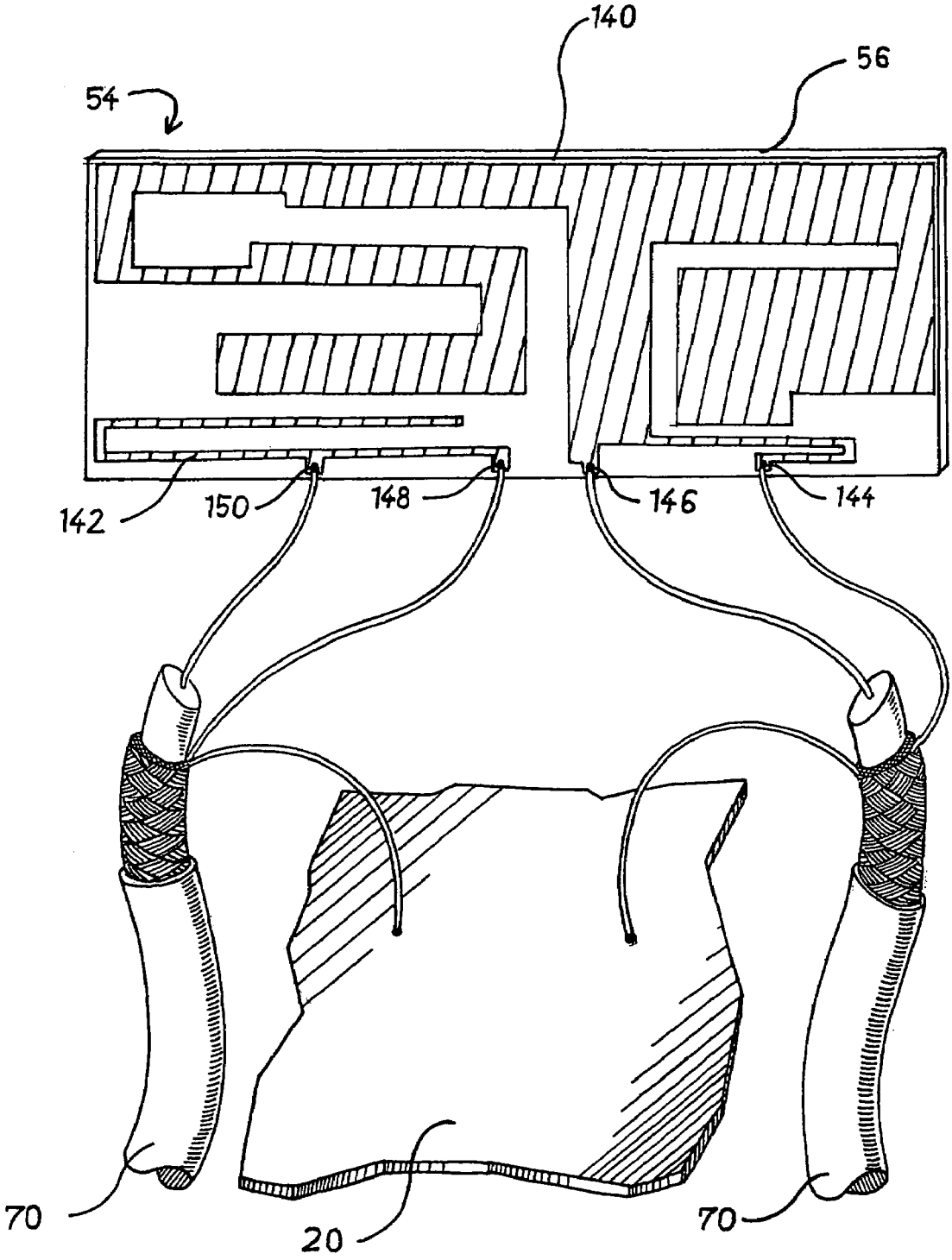
FIG. 5 illustrates a side elevational view of a multiple-band resonator element according to the present invention.

Referring now to FIG. 4, a second embodiment of the present invention is disclosed to include a second antenna 54 having a dielectric substrate 56 and disposed within a wireless communications device at an end opposite to the first resonator element 14. The antenna assembly 54 is likewise incorporated within the handset of a communications device 10. The second printed antenna 54 may include a single- or multiple-band wave resonator disposed relative to the ground plane 20 at an angle of 0–90 degrees. The ground plane 20 is preferably the ground traces of the PWB of a wireless communications device 10. Referring particularly to FIG. 5, the second resonator element 54 may include a multiple-band resonator as disclosed in the assignees's U.S. patent application Ser. No. 09/382,179, herein incorporated by reference in its entirety. FIG. 5 depicts a tri-band antenna assembly 54 functioning across a cellular band (880–960 MHz.), a PCS band (1710–1880 MHz.) and the BLUETOOTH™ band (2.4–2.5 GHz). Cellular and PCS band operation is effected through first conductor trace 140. BLUETOOTH™ band operation is effected through conductor trace 142. FIG. 5 illustrates an alternative feed approach, wherein the antenna assembly 54 is fed via coax signal lines 70. In this embodiment, the conductor trace 140 is coupled to the shield conductor of the coax 70 at region 144 and to the separate conductive panel 20. Center conductor of coax 70 (to signal generating circuitry 24) is coupled to the antenna element 54 via feedpoint 146. Conductor trace 142 is coupled to the shield conductor of the other coax 70 at region 148 and to the separate conductive panel 20. As described with reference to the earlier embodiments, the separate conductive panel 20 may be the internal ground plane of the printed wiring board of the wireless device. Conductor trace 142 is also coupled to the center conductor of coax 70 at feedpoint 150.

Figure 6:
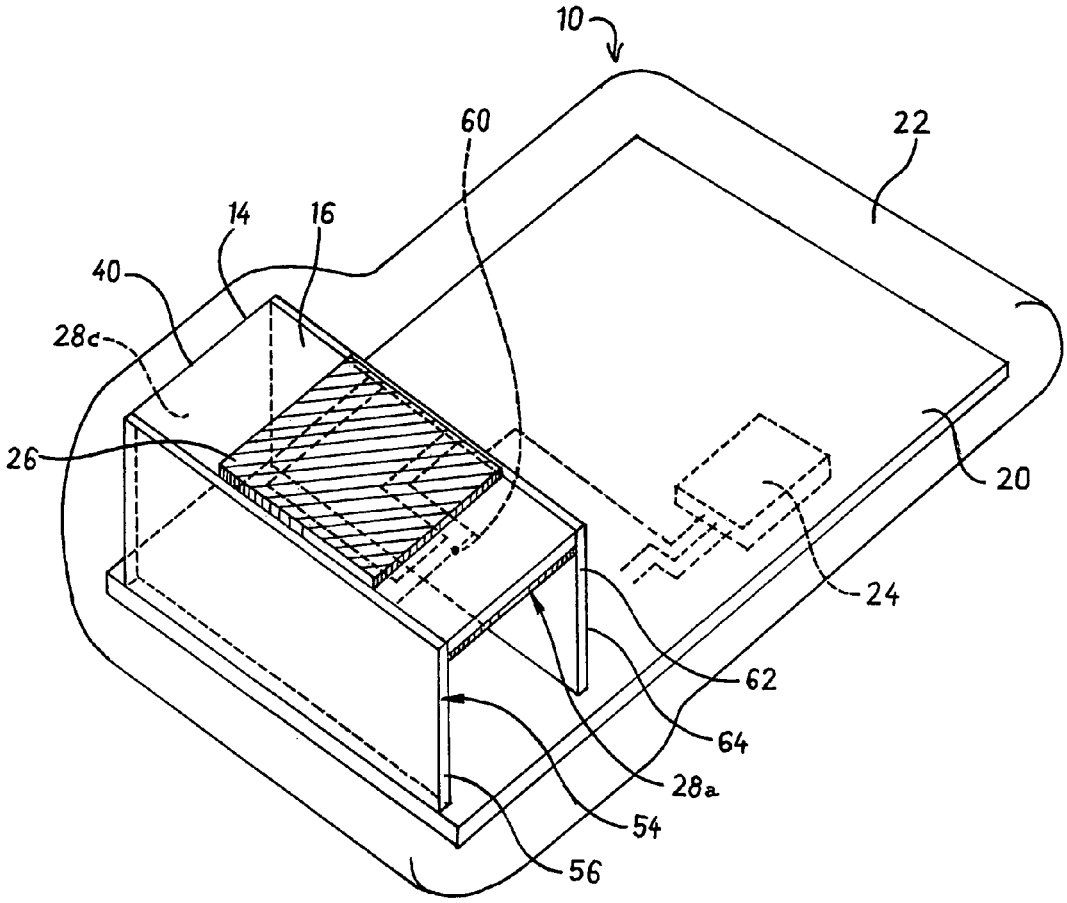
FIG. 6 illustrates yet another view of a wireless communications device utilizing an antenna assembly according to the present invention.

FIG. 6 illustrates a perspective view of a third embodiment of a GPS and wireless frequency band antenna 14, 54. A GPS quarter wave resonator 14 is fed by microstrip transmission line 60 disposed upon a dielectric substrate element 62 opposite a ground plane 64. A single or multiband quarter wave resonator 54 for a wireless communications band or bands may be utilized on dielectric substrate 56. The dielectric substrates 40, 56, 62 may be mechanically connected for structural integrity.

Although the invention has been described in connection with particular embodiments thereof other embodiments, applications, and modifications thereof which will be obvious to those skilled in the relevant arts are included within the spirit and scope of the invention.

We claim:

1. An antenna assembly for a communications device operating at a predetermined wavelength and having a transceiver circuit including a signal output and a ground plane, said antenna assembly comprising:

a first dielectric substrate element;

at least a pair of conductor trace elements disposed upon opposite sides of the first dielectric substrate element, at least one of the pair of conductor trace elements having a one-quarter wavelength electrical length and being capacitively coupled through the first dielectric substrate element to an other of said at least one of the pair of conductor trace elements; and a second substrate element including a second conductor trace element, said second trace element being coupled to the ground plane of the transceiver circuit, and said second substrate element being in substantially perpendicular relationship to said first dielectric substrate element wherein said at least a pair of conductor trace elements are resonator structures which transmit and receive electromagnetic radiation from a remote source.

* * * * *